US006965746B2

(12) United States Patent
Hays et al.

(10) Patent No.: US 6,965,746 B2
(45) Date of Patent: Nov. 15, 2005

(54) HYBRID ELECTROPHOTOGRAPHIC DEVELOPMENT WITH TONER INDUCTION CHARGED VIA AC INDUCED CONDUCTIVITY

(75) Inventors: Dan A. Hays, Fairport, NY (US); Jack T. LeStrange, Macedon, NY (US)

(73) Assignee: Xerox Corporation, Stamford, CT (US)

( * ) Notice: Subject to any disclaimer, the term of this patent is extended or adjusted under 35 U.S.C. 154(b) by 183 days.

(21) Appl. No.: 10/463,501

(22) Filed: Jun. 17, 2003

(65) Prior Publication Data

US 2004/0258435 A1 Dec. 23, 2004

(51) Int. Cl.[7] ..... G03G 15/09; G03G 15/08

(52) U.S. Cl. ..... 399/270; 399/266

(58) Field of Search ..... 399/252, 265, 399/266, 267, 270, 279, 282, 290, 291; 430/103, 110.1, 105, 110.2

(56) References Cited

U.S. PATENT DOCUMENTS

| | | | | |
|---|---|---|---|---|
| 4,286,543 A | * | 9/1981 | Ohnuma et al. | 399/270 X |
| 4,624,559 A | * | 11/1986 | Haneda et al. | 399/270 X |
| 5,017,967 A | * | 5/1991 | Koga | 399/265 |
| 5,473,418 A | * | 12/1995 | Kazakos et al. | 399/284 |
| 5,978,633 A | | 11/1999 | Hirsch et al. | 399/266 |
| 6,013,404 A | | 1/2000 | Feng et al. | 430/106.6 |
| 6,353,723 B1 | * | 3/2002 | Hays et al. | 399/266 X |
| 6,492,082 B1 | | 12/2002 | Moffat et al. | 430/108.22 |
| 6,503,678 B1 | | 1/2003 | Moffat et al. | 430/108.5 |
| 2002/0076102 A1 | | 6/2002 | Nagarajan et al. | 382/168 |

FOREIGN PATENT DOCUMENTS

EP 0 426 420 A2 5/1991

* cited by examiner

*Primary Examiner*—Sandra L. Brase
(74) *Attorney, Agent, or Firm*—Lloyd F. Bean, II

(57) ABSTRACT

A method is provided for developing a latent electrostatic image with marking particles through the process steps of: moving the surface of an image receiving member at a predetermined process speed; storing a supply of developer material comprising toner and carrier beads in a reservoirs said toner comprising electrically conductive core particles with an electrically insulating coating thereover; transporting marking particles onto an outer surface of a donor member to be delivered to a development zone adjacent the image receiving member; and inductive charging electrically conductive core particles of said toner onto said outer surface of said donor member prior to the development zone to a predefined charge level. Other features of the present invention will become apparent as the following description proceeds and upon reference to the drawings.

17 Claims, 2 Drawing Sheets

HYBRID ELECTROPHOTOGRAPHIC DEVELOPMENT WITH TONER INDUCTION CHARGED VIA AC INDUCED CONDUCTIVITY

BACKGROUND OF THE INVENTION

This invention relates generally to a development apparatus for ionographic or electrophotographic imaging and printing apparatuses and machines, and more particularly is directed to a two component development system wherein a donor roll is loaded with toner particles that are induction charged.

Generally, the process of electrophotographic printing includes charging a photoconductive member to a substantially uniform potential so as to sensitize the surface thereof. The charged portion of the photoconductive surface is exposed to a light image from either a scanning laser beam, an LED array or an original document being reproduced. By selectively discharging certain areas on the photoconductor, an electrostatic latent image is recorded on the photoconductive surface. This latent image is subsequently developed by charged toner particles supplied by the development sub-system.

Powder development systems normally fall into two classes: two component, in which the developer material is comprised of magnetic carrier granules having toner particles adhering triboelectrically thereto and single component, which typically uses toner only. Toner particles are attracted to the latent image forming a toner powder image on the photoconductive surface. The toner powder image is subsequently transferred to a copy sheet, and finally, the toner powder image is heated to permanently fuse it to the copy sheet in image configuration.

The electrostatic image in electrophotographic copying/printing systems is typically developed with a nonmagnetic, insulative toner that is charged by the phenomenon of triboelectricity. The triboelectric charging is obtained by either mixing the toner with larger carrier beads in a two component development system or by rubbing the toner between a blade and donor roll in a single component system. Although such powder development systems have served the electrophotographic industry well over the years, there continues to be a need for improvements in toner charging since triboelecticity is not well understood and predictable due to a strong materials sensitivity. The materials and environmental sensitivity causes difficulties in identifying a triboelectrically compatible set of color toners that can be blended for custom colors. Furthermore, to enable "offset" print quality with powder based electrophotographic development systems, a small toner (~5 $\mu$m) size is desired. Although the functionality of small triboelectrically charged toners has been demonstrated, concerns remain regarding the long-term robustness of such systems.

The operating latitude of a powder xerographic development system is determined to a great degree by the method with which toner particles are supplied to an electrostatic image. Placing charge on the particles, to enable movement and imagewise development via electric fields, is most often accomplished with triboelectricity. However, all development systems which use triboelectricity to charge toner, whether they be two component (toner and carrier) or mono-component (toner only), have one feature in common: charges are distributed non-uniformly on the surface of the toner. This results in high electrostatic adhesion due to locally high surface charge densities on the particles. Toner adhesion, especially in the development step, is a key factor which limits performance by hindering toner release. As the toner particle size is reduced to enable higher image quality, the charge Q on a triboelectrically charged particle, and thus the removal force (F=QE) acting on the particle due to the development electric field E, will drop roughly in proportion to the particle surface area. On the other hand, the electrostatic adhesion forces for tribo-charged toner, which are dominated by charged regions on the particle at or near its points of contact with a surface, do not decrease as rapidly with decreasing size. This so-called "charge patch" effect makes smaller, tribo-charged particles much more difficult to develop and control.

Jumping development systems, in which toner is required to jump a gap to develop the electrostatic latent image, are capable of image quality which can be superior to in-contact systems, such as magnetic brush Is development. Unfortunately, they are also much more sensitive to toner adhesion. In fact, high toner adhesion has been identified as a major limitation in jumping development. Up now, mechanical and/or electrical agitation of toner have been used to overcome the adhesion forces and allow toner to be released into a cloud for jumping development. This approach has had limited success, however. More agitation often releases more toner, but high adhesion due to triboelectric charging still dominates in toner cloud generation and causes unstable development. For full color printing system architectures in which the complete image is formed on the image bearing member, an increase in toner delivery rate produces a highly interactive toner cloud, which disturbs previously developed particles on the latent image. This erases many of the original benefits of jumping development for color xerographic printing for the so-called image-on-image (IOI) architecture. Again, as the toner size is reduced, the above limitations become even more acute due to increased toner adhesion.

Given that charged particle adhesion is a major limiting factor in development with dry powder, it has been a goal to identify toner charging and delivery schemes which keep toner adhesion low. Clearly, the adhesion of the charged toner depends sensitively on the method used to charge the particles.

To circumvent limitations associated with development systems based on triboelectrically charged toner, non-tribo toner charging systems are desired to enable a more stable development system with greater latitude in toner materials. Conventional single component development (SCD) systems based on induction charging utilize a magnetic loaded toner to suppress background deposition. However, the magnetic material precludes bright colors.

To circumvent these problems, a new electrophotographic development system design has been described in U.S. Pat. Nos. 6,503,678, 6,492,082, and 6,353,723, and U.S. application Ser. Nos. 09/739,405 and 09/724,064 which hereby are incorporated by reference. The patents and applications disclose a single component development system based on the induction charging of conductive, nonmagnetic toner prior to the development zone. The conductive toner can either be electrostatically transferred to an (insulative) intermediate belt and/or rheologically transferred directly to paper.

SUMMARY OF THE INVENTION

A method is provided for developing a latent electrostatic image with marking particles through the process steps of: moving the surface of an image receiving member at a predetermined process speed; storing a supply of developer material comprising toner and carrier beads in a reservoirs said toner comprising electrically conductive core particles with an electrically insulating coating thereover; transporting marking particles onto an outer surface of a donor member to be delivered to a development zone adjacent the image receiving member; and inductive charging electrically conductive core particles of said toner onto said outer surface of said donor member prior to the development zone to a predefined charge level. Other features of the present invention will become apparent as the following description proceeds and upon reference to the drawings.

BRIEF DESCRIPTION OF THE DRAWINGS

In the detailed description of the invention presented below, reference is made to the drawings, in which.

DESCRIPTION OF THE INVENTION

While the present invention will hereinafter be described in connection with various embodiments and methods of use, it will be understood that it is not intended to limit the invention to these embodiments and methods of use. On the contrary, it is intended to cover all alternatives, modifications and equivalents as may be included within the spirit and scope of the invention as defined by the appended claims.

Figure 1:
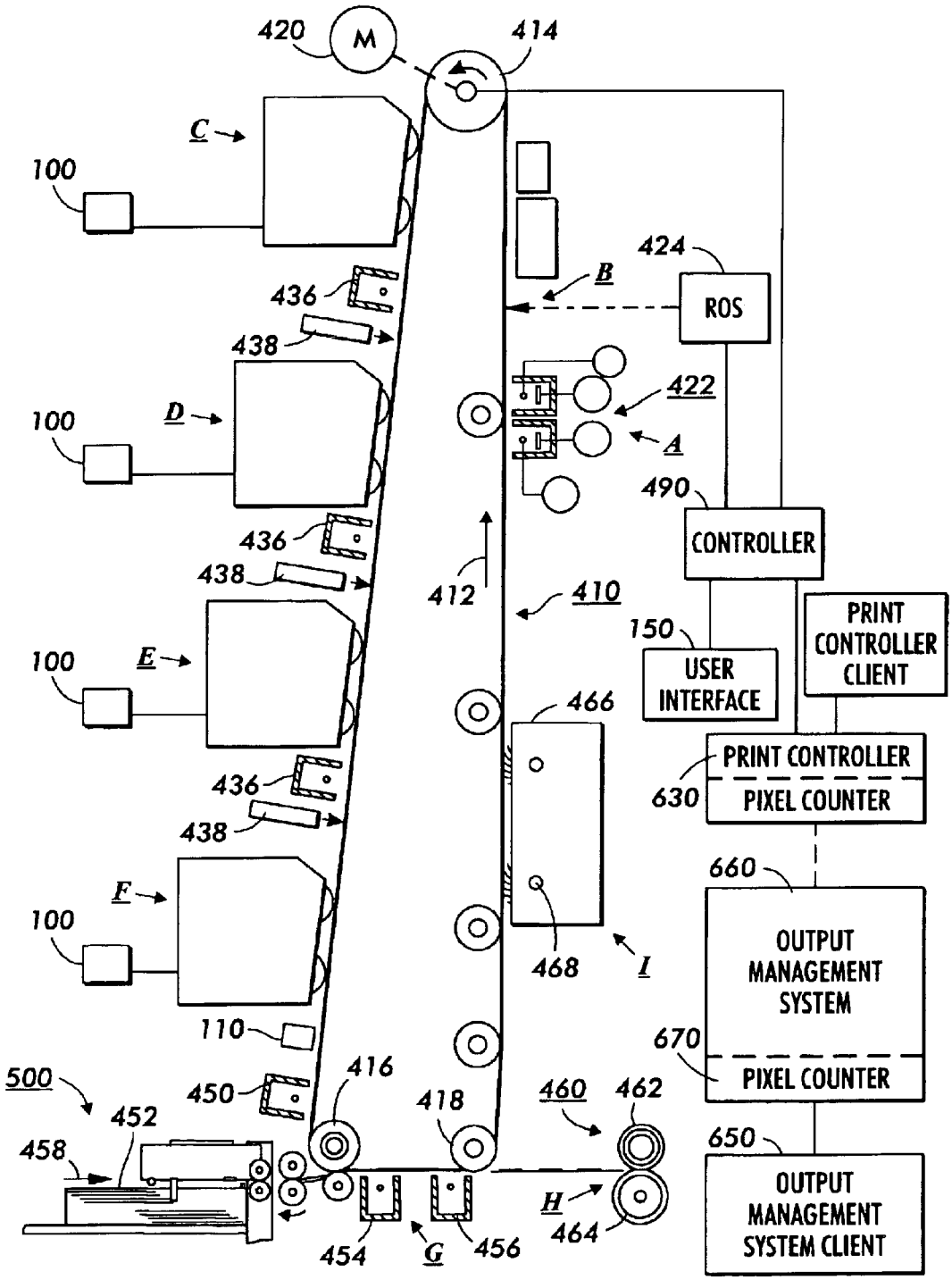
FIG. 1 is a schematic elevational view of an illustrative electrophotographic printing or imaging machine or apparatus incorporating a development apparatus having the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the features of the present invention therein. It will become apparent from the following discussion that the apparatus of the present invention is equally well suited for use in a wide variety of machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

Referring initially to FIG. 1, there is shown an illustrative electrophotographic machine having incorporated therein the development apparatus of the present invention. Printing jobs may be submitted from the Output Management System Client 650 to the Output Management System 660. A pixel counter 670 is incorporated into the Output Management System 660 to count the number of pixels to be imaged with toner on each sheet or page of the job, for each color. The pixel count information is stored in the Output Management System memory. The Output Management System 660 submits job control information, including the pixel count data, and the printing job to the Print Controller 630. Job control information, including the pixel count data, and digital image data are communicated from the Print Controller 630 to the Controller 490. In this alternative embodiment, pixel counting in the Print Controller 630 is not necessary since the data has been provided with the job control information from the Output Management System 660.

The printing system preferably uses a charge retentive surface in the form of an Active Matrix (AMAT) photoreceptor belt 410 supported for movement in the direction indicated by arrow 412, for advancing sequentially through the various xerographic process stations. The belt is entrained about a drive roller 414, tension rollers 416 and fixed roller 418 and the drive roller 414 is operatively connected to a drive motor 420 for effecting movement of the belt through the xerographic stations. A portion of belt 410 passes through charging station A where a corona generating device, indicated generally by the reference numeral 422, charges the photoconductive surface of photoreceptor belt 410 to a relatively high, substantially uniform, preferably negative potential.

Next, the charged portion of photoconductive surface is advanced through an imaging/exposure station B. At imaging/exposure station B, a controller, indicated generally by reference numeral 490, receives the image signals from Print Controller 630 representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 424. Alternatively, the ROS 424 could be replaced by other xerographic exposure devices such as LED arrays.

The photoreceptor belt 410, which is initially charged to a voltage V0, undergoes dark decay to a level equal to about −500 volts. When exposed at the exposure station B, it is discharged to a level equal to about −50 volts. Thus after exposure, the photoreceptor belt 410 contains a monopolar voltage profile of high and low voltages, the former corresponding to charged areas and the latter corresponding to discharged or background areas.

At a first development station C, developer structure, indicated generally by the reference numeral utilizing a hybrid development system. The development roll, better known as the donor roll, is supplied with two types of development electric fields (potentials across an air gap). The first electric field is an AC field which is used for toner cloud generation. The second electric field is a DC development field which is used to control the amount of developed toner mass on the photoreceptor belt 410. The toner cloud causes charged toner particles to be attracted to the electrostatic latent image. Appropriate developer biasing is accomplished via a power supply. The hybrid development system is a noncontact type in which only toner particles (black, for example) are attracted to the latent image and there is no mechanical contact between the photoreceptor belt 410 and a toner delivery device to disturb a previously developed, but unfixed, image. A toner concentration sensor 100 senses the toner concentration in the developer structure.

The developed but unfixed image is then transported past a second charging device 436 where the photoreceptor belt 410 and previously developed toner image areas are recharged to a predetermined level.

A second exposure/imaging is performed by device 438 which comprises a laser based output structure is utilized for selectively discharging the photoreceptor belt 410 on toned areas and/or bare areas, pursuant to the image to be developed with the second color toner. At this point, the photoreceptor belt 410 contains toned and untoned areas at relatively high voltage levels and toned and untoned areas at relatively low voltage levels. These low voltage areas represent image areas which are developed using discharged area development (DAD). To this end, a negatively charged, developer material comprising color toner is employed. The toner, which by way of example may be yellow, is contained in a developer housing structure disposed at a second developer station D and is presented to the latent images on the photoreceptor belt 410 by way of a second developer system. A power supply (not shown) serves to electrically bias the developer structure to a level effective to develop the discharged image areas with negatively charged yellow toner particles. Further, a toner concentration sensor 100 senses the toner concentration in the developer structure.

The above procedure is repeated for a third image for a third suitable color toner such as magenta (station E) and for a fourth image and suitable color toner such as cyan (station F). The exposure control scheme described below may be utilized for these subsequent imaging steps. In this manner a full color composite toner image is developed on the photoreceptor belt 410. In addition, a mass sensor 110 measures developed mass per unit area. Although only one mass sensor 110 is shown in FIG. 1, there may be more than one mass sensor 110.

To the extent to which some toner charge is totally neutralized, or the polarity reversed, thereby causing the composite image developed on the photoreceptor belt 410 to consist of both positive and negative toner, a negative pre-transfer dicorotron member 450 is provided to condition the toner for effective transfer to a substrate using positive corona discharge.

Subsequent to image development a sheet of support material 452 is moved into contact with the toner images at transfer station G. The sheet of support material 452 is advanced to transfer station G by a sheet feeding apparatus 500, described in detail below. The sheet of support material 452 is then brought into contact with photoconductive surface of photoreceptor belt 410 in a timed sequence so that the toner powder image developed thereon contacts the advancing sheet of support material 452 at transfer station G.

Transfer station G includes a transfer dicorotron 454 which sprays positive ions onto the backside of sheet 452. This attracts the negatively charged toner powder images from the photoreceptor belt 410 to sheet 452. A detack dicorotron 456 is provided for facilitating stripping of the sheets from the photoreceptor belt 410.

After transfer, the sheet of support material 452 continues to move, in the direction of arrow 458, onto a conveyor (not shown) which advances the sheet to fusing station H. Fusing station H includes a fuser assembly, indicated generally by the reference numeral 460, which permanently affixes the transferred powder image to sheet 452. Preferably, fuser assembly 460 comprises a heated fuser roller 462 and a backup or pressure roller 464. Sheet 452 passes between fuser roller 462 and backup roller 464 with the toner powder image contacting fuser roller 462. In this manner, the toner powder images are permanently affixed to sheet 452. After fusing, a chute, not shown, guides the advancing sheets 452 to a catch tray, stacker, finisher or other output device (not shown), for subsequent removal from the printing machine by the operator.

After the sheet of support material 452 is separated from photoconductive surface of photoreceptor belt 410, the residual toner particles carried by the non-image areas on the photoconductive surface are removed therefrom. These particles are removed at cleaning station 1 using a cleaning brush or plural brush structure contained in a housing 466. The cleaning brush 468 or brushes 468 are engaged after the composite toner image is transferred to a sheet. Once the photoreceptor belt 410 is cleaned the brushes 468 are retracted utilizing a device incorporating a clutch (not shown) so that the next imaging and development cycle can begin.

Controller 490 regulates the various printer functions. The controller 490 is preferably a programmable controller, which controls printer functions hereinbefore described. The controller 490 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator. Conventional sheet path sensors or switches may be utilized to keep track of the position of the document and the copy sheets.

It is believed that the foregoing description is sufficient for purposes of the present application to illustrate the general operation of an electrophotographic printing machine incorporating the development apparatus of the present invention therein.

Figure 2:
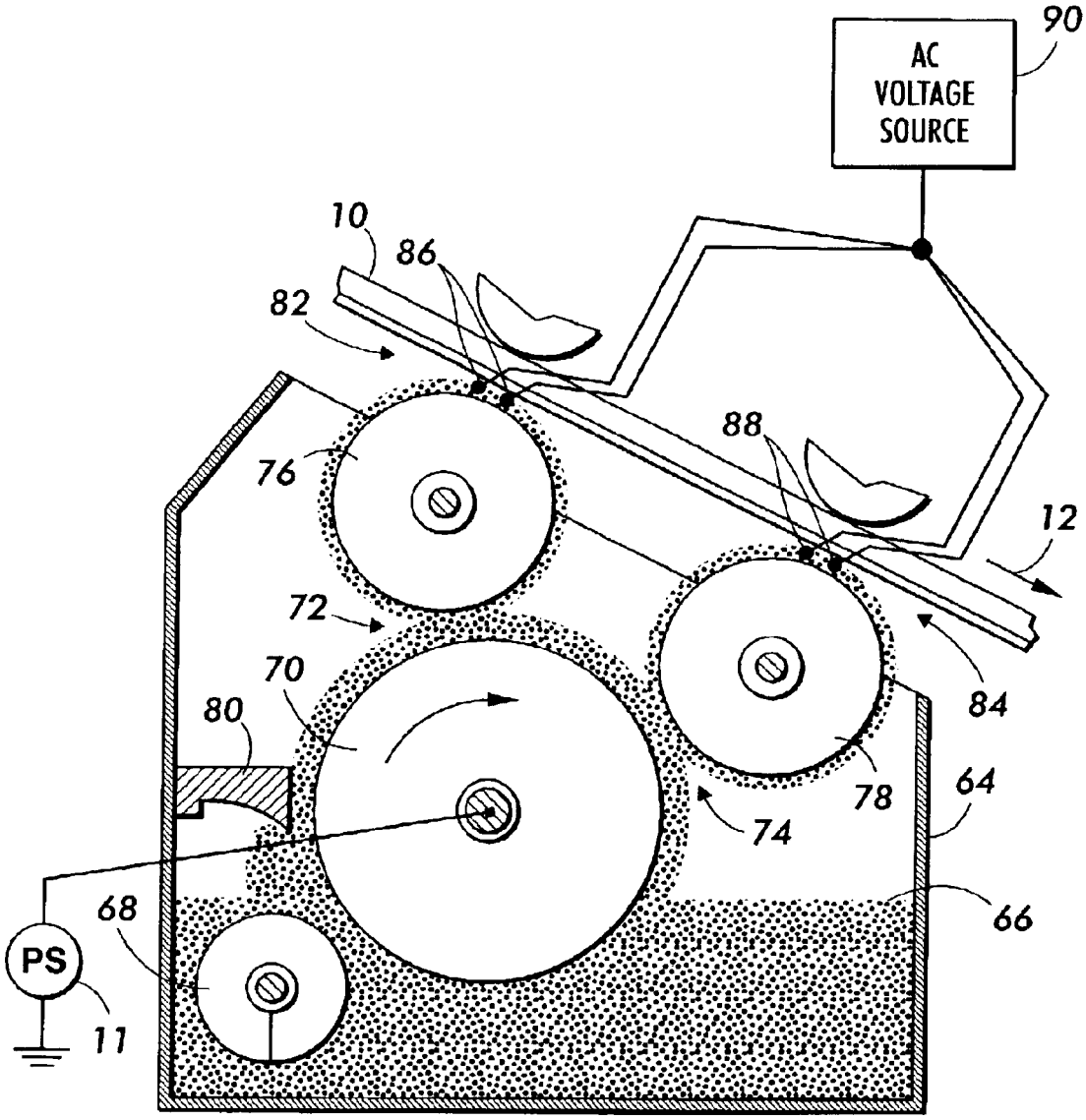
FIG. 2 is a schematic elevational view of a development apparatus having the features of the present invention therein.

Now focusing on the development system of the present invention, referring now to FIG. 2, there is shown the details of the development apparatus 32. The apparatus comprises a reservoir 64 containing developer material 66. The developer material 66 is of the two component type, that is it comprises carrier granules and toner particles. The reservoir includes augers, indicated at 68, which are rotatably-mounted in the reservoir chamber. The augers 68 serve to disperse toner in the carrier, transport the developer and to agitate the material within the reservoir to encourage the toner particles to adhere triboelectrically to the carrier granules.

A magnetic brush roll 70 transports developer material from the reservoir to the loading nips 72, 74 of two donor rolls 76, 78. Magnetic brush rolls are well known, so the construction of roll 70 need not be described in great detail. Briefly the roll comprises a rotatable tubular housing within which is located a stationary magnetic cylinder having a plurality of magnetic poles impressed around its surface. The carrier granules of the developer material are magnetic and, as the tubular housing of the roll 70 rotates, the granules (with toner particles adhering triboelectrically thereto) are attracted to the roll 70 and are conveyed to the donor roll loading nips 72, 74.

A metering blade 80 removes excess developer material from the magnetic brush roll and ensures an even depth of coverage with developer material before arrival at the first donor roll loading nip 72. At each of the donor roll loading nips 72, 74, toner particles are transferred from the magnetic brush roll 70 to the respective donor roll 76, 78. Each donor roll transports the toner to a respective development zone 82, 84 through which the photoconductive belt 10 passes.

Transfer of toner from the magnetic brush roll 70 to the donor rolls 76, 78 can be encouraged by, for example, the application of a suitable AC bias and a DC electrical bias to the magnetic brush and/or donor rolls to cause induction charging of the toner. The DC bias (for example, approximately 100 v applied to the magnetic roll) establishes an electrostatic field between the donor roll and magnetic brush rolls, which causes toner particles to be attracted to the donor roll from the carrier granules on the magnetic roll. The carrier granules and any toner particles that remain on the magnetic brush roll 70 are returned to the reservoir 64 as the magnetic brush continues to rotate. The relative amounts of toner transferred from the magnetic roll 70 to the donor rolls 76, 78 can be adjusted, for example by: applying different bias voltages to the donor rolls; adjusting the magnetic to donor roll spacing; adjusting the strength and shape of the magnetic field at the loading nips and/or adjusting the speeds of the donor rolls.

At each of the development zones 82, 84, toner is transferred from the respective donor roll 76, 78 to the latent image on the belt 10 to form a toner powder image on the latter. Various methods of achieving an adequate transfer of toner from a donor roll to a photoconductive surface are known and any of those may be employed at the development zones 82, 84.

In FIG. 2, each of the development zones 82, 84 is shown as having electrode wires disposed in the space between each donor roll 76, 78 and the belt 10. FIG. 2 shows, for each donor roll 76, 78, a respective pair of electrode wires 86, 88 extending in a direction substantially parallel to the longitudinal axis of the donor roll. The electrode wires are made from thin (i.e. 50 to 100.mu. diameter) tungsten wires which are closely spaced from the respective donor roll. The distance between each wire and the respective donor roll is within the range from about 10.mu. to about 40.mu. (typically approximately 25.mu.) or the thickness of the toner layer on the donor roll. To this end the extremities of the wires are supported by the tops of end bearing blocks that also support the donor rolls for rotation. The wire extremities are attached so that they are slightly below a tangent to the surface, including the toner layer, of the donor roll structure. An alternating electrical bias is applied to the electrode wires by an AC voltage source 90. The applied AC establishes an alternating electrostatic field between each pair of wires and the respective donor roll, which is effective in detaching toner from the surface of the donor roll and forming a toner cloud about the wires, the height of the cloud being such as not to be substantially in contact with the belt 10.

The magnitude of the AC voltage is relatively low, for example in the order of 200 to 500 volts peak at a frequency ranging from about 3 kHz to about 12 kHz. A DC bias supply (not shown) applied to each donor roll 76, 78 establishes electrostatic fields between the belt 10 and donor rolls for attracting the detached toner particles from the clouds surrounding the wires to the latent image recorded on the photoconductive surface of the belt.

At a spacing ranging from about 10.mu. to about 40.mu. between the electrode wires and donor rolls, an applied voltage of 200 to 500 volts produces a relatively large electrostatic field without risk of air breakdown. The use of a dielectric coating on either the electrode wires or donor roller helps to prevent shorting of the applied AC voltage. As successive electrostatic latent images are developed, the toner particles within the developer material 66 are depleted. A toner dispenser (not shown) stores a supply of toner particles. The toner dispenser is in communication with reservoir 64 and, as the concentration of toner particles in the developer material is decreased, fresh toner particles are furnished to the developer material in the reservoir.

The auger 68 in the reservoir chamber mix the fresh toner particles with the remaining developer material so that the resultant developer material therein is substantially uniform with the concentration of toner particles being optimized. In this way, a substantially constant amount of toner particles is in the reservoir. In the arrangement shown in FIG. 2, the donor rolls 76, 78 and the magnetic brush roll 70 can be rotated either "with" or "against" the direction of motion of the belt 10.

The two-component developer 66 used in the apparatus of FIG. 2 is a preferred toner composition as disclosed in U.S. Pat. No. 6,013,404. The toner composition consists of an electrically conductive core with an electrically insulating shell for the purpose of reducing toner adhesion.

Now focusing on the operation of the present invention, an AC and DC voltage applied by power supply 11 between the magnetic brush and donor rolls induces charge in the toner via electrical breakdown of the toner insulative coating. The induction charged toner is loaded on a charge relaxable overcoated donor roll. The induction charging of toner prior to the development zone enables electrostatic control of background deposition. Since the toner with a conductive core has an insulative coating, the electrical properties of the toner will be similar to that of insulative toner since toner-toner contacts or toner-paper contacts will not induce substantial changes in the toner charge provided the electric fields are below the threshold for electrical breakdown.

The development of an electrostatic image on the photoreceptor can be one of many methods including synchronous contact development, DC jumping across a gap, AC/DC jumping across a gap and toner cloud generation for non-interactive development as obtained with AC bias wires in self-spaced contact with a toned donor roll as discussed above.

Preferably the overcoating on the donor roll is anodized aluminum, titania doped alumina applied with a plasma spray, and one of many polymeric coatings that includes an oxidizing agent in a hole-transporting polymer. The donor can also be in the form of a belt with an overcoating of an oxidizing agent in a hole-transporting polymer, for example. The dielectric thickness of the overcoating should be sufficiently thin to provide high electric fields during the AC induced toner charging and loading on the donor. The overcoating conductivity must be sufficiently low to enable toner charging and yet sufficiently high to dissipate any charge accumulation on the roll surface.

It should be understood that all of the specific material formulations described in U.S. Pat. No. 6,013,404, hereby incorporated by reference, are applicable to the nonmagnetic toner composition employed with the present invention. Some specific examples include a bulk conductive core consisting of at least one resin, colorant and conductive additives such as electrically conductive polymers, metal particles, metal oxide particles, conductive fluorocarbon particles, polyanilines, polypyrroles, polythiophenes, and conductive charge transfer complexes. The conductive core can also consist of an insulative bulk composition overcoated with a surface rendered conductive by one of many methods including a coating of metal oxides, metal halides, etc. It should be understood that the conductive core can be produced by either grinding or chemical toner manufacturing processes.

The conductive core or conductive shell on an insulative core is overcoated with an insulative coating. The insulative coating can consist of at least one insulative resin, a mixture of resins, and mixtures thereof with insulative particles such as metal oxide particles. The insulating coating can be applied from a solution or high intensity blending of insulative powders onto the surface of the conductive core. The insulative powder can consist of organic materials such as polymethylmethacrylate, zinc stearate, etc. or inorganic materials such as silica, alumina, and other inorganic materials that are commonly used as surface additives to increase the flow properties of toner.

The auger mixing of the developer in the sump will cause the toner with the insulative coating to become triboelectrically charged against the conductive carrier beads which, in general, can be partially polymeric coating. A certain degree of triboelectric charging helps to uniformly disperse the toner in the developer. During the AC induced toner charging and loading on the donor, it is assumed that the toner charge level will be controlled by the induction charging electric field. Thus, any prior triboelectric charging of the toner will be nullified due to a compensating charge that will flow to the conductive core once electrical contact is established via the electrical breakdown of the toner insulative coating.

In recapitulation, there has been provided a method for developing a latent electrostatic with marking particles including moving the surface of an image receiving member at a predetermined process speed; storing a supply of developer material comprising toner and carrier beads and toner in a reservoir, said toner comprising electrically conductive core particles with an electrically insulating coating thereover; transporting marking particles onto an outer surface of a donor member to be delivered to a development zone adjacent the image receiving member; and inductive charging electrically conductive core particles of said toner onto said outer surface of said donor member prior to the development zone to a predefined charge level; wherein said transporting includes attracting said developer material from said reservoir with a magnetic member; generating a magnetic brush comprise of said toner and said carrier beads; and delivering toner to said donor member; wherein said inductive charging step includes the step of AC and DC biasing said magnetic brush relative to the donor member to achieve electrical breakdown of an electrically insulating coating of said toner thereby inducing charge in said toner; providing a donor member comprises a conductive substrate and a charge relaxable dielectric layer on an outer surface of said conductive substrate; said inductive charging step includes the step of adjusting DC bias from about 30 to 200 volts and preferably near 100 volts of either positive or negative polarity to achieve said predefined charge level; wherein said inductive charging step includes the step of adjusting a sine or square wave AC bias amplitude from about 500 volts peak-to-peak to 2500 volts peak-to-peak, and preferable near 1500 volts perk-to-peak to achieve said predefined charge level. Wherein said inductive charging step includes the step of adjusting AC frequency from about 1 to 12 kHz and preferably 3 kHz to achieve said predefined charge level; wherein said electrically conductive core particles has a resistivity from about $10^5$ to $10^9$ ohm-cm. Wherein said electrically insulating coating has a resistivity from about $10^{15}$ to $10^{18}$ ohm-cm; and wherein said dielectric layer has a resistivity from about $10^6$ to $10^9$ ohm-cm.

It is, therefore, apparent that there has been provided in accordance with the present invention, an apparatus for developing a latent image that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternative, modifications and variations that fall within the spirit and broad scope of the appended claims.

What is claimed is:

1. A method of for developing a latent electrostatic image recorded with marking particles, to form a developed image, comprising:

moving the surface of an image receiving member at a predetermined process speed:

storing a supply of developer material comprising toner and carrier beads in a reservoir, said toner comprising electrically conductive core particles with an electrically insulating coating thereover:

transporting marking particles onto an outer surface of a donor member to be delivered to a development zone adjacent the image receiving member; said transporting includes attracting said developer material from said reservoir with a magnetic member; generating a magnetic brush comprise of said toner and said carrier beads; and delivering toner to said donor member; and inductive charging electrically conductive core particles of said toner onto said outer surface of said donor member prior to the development zone to a predefined charge level said inductive charging includes the step of AC and DC biasing said magnetic brush relative to the donor member to achieve electrical breakdown of an electrically insulating coating of said toner thereby inducing charge in said toner.

2. The method of claim 1, further comprising providing a donor member comprises a conductive substrate and a charge relaxable dielectric layer on an outer surface of said conductive substrate.

3. The method of claim 1, wherein said dielectric layer has a resistivity from about $10^6$ to $10^9$ ohm-cm.

4. The method of claim 1 wherein said inductive charging includes the step of adjusting DC bias from about 30 to 200 volts and preferably near 100 volts of either positive or negative polarity to achieve said predefined charge level.

5. The method of claim 1, wherein said electrically conductive core particles has a resistivity from about $10^5$ to $10^9$ ohm-cm.

6. The method of claim 1, wherein said electrically insulating coating has a resistivity from about $10^{15}$ to $10^{18}$ ohm-cm.

7. A method of for developing a latent electrostatic image recorded with marking particles, to form a developed image, comprising:

moving the surface of an image receiving member at a predetermined process speed:

storing a supply of developer material comprising toner and carrier beads in a reservoir, said toner comprising electrically conductive core particles with an electrically insulating coating thereover;

transporting marking particles onto an outer surface of a donor member to be delivered to a development zone adjacent the image receiving member; and inductive charging electrically conductive core particles of said toner onto said outer surface of said donor member prior to the development zone to a predefined charge level; said inductive charging includes adjusting a sine or a square wave AC bias amplitude from about 500 volts peak-to-peak to 2500 volts peak-to-peak, and preferably near 1500 volts peak-to-peak to achieve said predefined charge level.

8. The method of claim 6, wherein said inductive charging includes the step of adjusting AC frequency from about 1 to 12 kHz and preferably 3 kHz to achieve said predefined charge level.

9. An electrostatic printing machine using a method of for developing a latent electrostatic image recorded with marking particles, to form a developed image, comprising:

moving the surface of an image receiving member at a predetermined process speed:

storing a supply of developer material comprising toner and carrier beads and toner in a reservoir, said toner comprising electrically conductive core particles with an electrically insulating coating thereover;

transporting marking particles onto an outer surface of a donor member to be delivered to a development zone adjacent the image receiving member; and inductive charging electrically conductive core particles of said toner onto said outer surface of said donor member prior to the development zone to a predefined charge level; wherein said inductive charging includes the AC and DC biasing and magnetic brush relative to the donor member to achieve electrical breakdown of an electrically insulating coating of said toner thereby inducing charge in said toner.

10. The method of claim 9, wherein said transporting includes attracting said developer material from said reservoir with a magnetic member; generating a magnetic brush comprise of said toner and said carrier beads; and delivering toner to said donor member.

11. The method of claim 9, further comprising providing a donor member comprises a conductive substrate and a charge relaxable dielectric layer on an outer surface of said conductive substrate.

12. The method of claim 11, wherein said dielectric layer has a resistivity from about $10^6$ to $10^9$ ohm-cm.

13. The method of claim 9, wherein said inductive charging includes of adjusting DC bias from about 30 to 200 volts and preferably near 100 volts of either positive or negative polarity to achieve said predefined charge level.

14. The method of claim 9, wherein said inductive charging step includes adjusting a sine or square wave AC bias amplitude from about 500 volts peak-to-peak to 2500 volts peak-to-peak, and preferable near 1500 volts peak-to-peak to achieve said predefined charge level.

15. The method of claim 14, wherein said inductive charging includes the step of adjusting AC frequency from about 1 to 12 kHz and preferably 3 kHz to achieve said predefined charge level.

16. The method of claim 9, wherein said electrically conductive core particles has a resistivity from about $10^5$ to $10^9$ ohm-cm.

17. The method of claim 9, wherein said electrically insulating coating has a resistivity from about $10^{15}$ to $10^{18}$ ohm-cm.

* * * * *